US007490539B2

(12) United States Patent
Ma

(10) Patent No.: US 7,490,539 B2
(45) Date of Patent: Feb. 17, 2009

(54) LIGHTWEIGHT COMPOSITE ARMOR

(75) Inventor: Zheng-Dong Ma, Ann Arbor, MI (US)

(73) Assignee: MKP Structural Design Associates, Inc., Ann Arbor, MI (US)

( * ) Notice: Subject to any disclaimer, the term of this patent is extended or adjusted under 35 U.S.C. 154(b) by 309 days.

(21) Appl. No.: 11/187,378

(22) Filed: Jul. 22, 2005

(65) Prior Publication Data

US 2007/0089597 A1 Apr. 26, 2007

(51) Int. Cl.
*F41H 5/02* (2006.01)

(52) U.S. Cl. ..... 89/36.02; 89/36.07; 89/36.01; 89/36.08

(58) Field of Classification Search ..... 89/36.02, 89/36.08, 36.07, 36.1, 36.05; 428/601, 47, 428/48, 49, 98, 221
See application file for complete search history.

(56) References Cited

U.S. PATENT DOCUMENTS

| | | | | |
|---|---|---|---|---|
| 821,393 | A | 5/1906 | Wright et al. | |
| 3,555,131 | A | 1/1971 | Weismann | |
| 3,996,443 | A | 12/1976 | Keller | 219/56 |
| 4,079,560 | A | 3/1978 | Weismann | 52/309.7 |
| 4,179,979 | A | 12/1979 | Cook et al. | 89/36 |
| 4,226,067 | A | 10/1980 | Artzer | 52/309.12 |
| 4,268,560 | A | 5/1981 | Maistre | 428/105 |
| 4,328,272 | A | 5/1982 | Maistre | 428/105 |
| 4,395,615 | A | 7/1983 | Tanenbaum | 219/79 |
| 4,448,832 | A | 5/1984 | Kidwell | 428/113 |
| 4,606,961 | A | 8/1986 | Munsen et al. | 428/119 |
| 4,614,013 | A | 9/1986 | Stevenson | 29/155 |
| 4,690,850 | A | 9/1987 | Fezio | 428/105 |
| 4,875,322 | A | 10/1989 | Rozzi | 52/746 |
| 5,108,810 | A | 4/1992 | Williams | 428/36.1 |
| 5,332,178 | A | 7/1994 | Williams | 244/123 |
| 5,398,470 | A | 3/1995 | Ritter et al. | 52/309.11 |
| 5,466,506 | A | 11/1995 | Freitas et al. | 428/105 |
| 5,649,403 | A | 7/1997 | Haisch | 52/693 |
| 5,688,571 | A | 11/1997 | Quigley et al. | 428/36.1 |
| 5,741,574 | A | 4/1998 | Boyce et al. | 428/119 |
| 5,746,765 | A | 5/1998 | Kleshinski et al. | 606/198 |
| 5,763,813 | A | 6/1998 | Cohen et al. | 89/36.02 |
| 5,804,277 | A | 9/1998 | Ashbee | 428/112 |
| 5,806,798 | A | 9/1998 | Gillandt et al. | 244/123 |
| 5,869,165 | A | 2/1999 | Rorabaugh et al. | 428/105 |
| 5,904,025 | A | 5/1999 | Bass et al. | 52/741.3 |
| 5,935,680 | A | 8/1999 | Childress | 428/119 |
| 5,962,150 | A | 10/1999 | Priluck | 428/596 |

(Continued)

*Primary Examiner*—John W Eldred
(74) *Attorney, Agent, or Firm*—Gifford, Krass, Sprinkle, Anderson & Citkowski, PC

(57) ABSTRACT

Improved composite armor designs use optimally shaped ceramic pellets and a web system for patterning the pellets, improving manufacturability, and providing additional structural reinforcement. The result is lightweight, composite hybrid structures for ballistic protection particularly suited to tactical ground vehicles. The preferred embodiment is a combination of three major components: 1) an optimally designed web system that allows armor tiles to be attached to it and that can be easily integrated with existing vehicle structures; 2) an advanced composite armor unit using a patent-pending BTR (Bio-mimetic Tendon-Reinforced) material as the supporting structure; and 3) optimally placed "waiting materials" which can provide enhanced ballistic impact resistance, energy absorption capability and structural integrity. These "waiting materials" are structural members that are not active at the beginning of the ballistic impact, but become active when needed or the active members have failed.

35 Claims, 11 Drawing Sheets

U.S. PATENT DOCUMENTS

| | | | | |
|---|---|---|---|---|
| 5,981,023 | A | 11/1999 | Tozuka et al. | 428/105 |
| 6,112,635 | A * | 9/2000 | Cohen | 89/36.02 |
| 6,203,908 | B1 | 3/2001 | Cohen | 428/397 |
| 6,207,256 | B1 | 3/2001 | Tashiro | 428/178 |
| 6,237,297 | B1 | 5/2001 | Paroly | 52/652.1 |
| 6,644,535 | B2 | 11/2003 | Wallach et al. | 228/173.5 |
| 6,645,333 | B2 | 11/2003 | Johnson et al. | 156/92 |
| 6,681,981 | B2 | 1/2004 | Paroly | 228/47.1 |
| 6,708,922 | B1 | 3/2004 | Hamilton | 244/30 |
| 6,892,623 | B2 * | 5/2005 | Benyami et al. | 89/36.02 |
| 7,117,780 | B2 * | 10/2006 | Cohen | 89/36.02 |
| 2003/0017053 | A1 | 1/2003 | Baldwin et al. | 416/229 |

* cited by examiner

LIGHTWEIGHT COMPOSITE ARMOR

GOVERNMENT SUPPORT

This invention was made with government support under Contract No. W56HZV-05-C-0098, entered into with the United States Army Tank-Automotive Research, Development and Engineering Center (TARDEC). The Government may have certain rights in the invention.

FIELD OF THE INVENTION

This invention relates generally to ballistic armor and, in particular, to a lightweight composite ballistic armor for military and tactical vehicles.

BACKGROUND OF THE INVENTION

The terrorist attacks of Sep. 11, 2001 in New York City and Washington, D.C., and the current war in Iraq, have heightened the need for ballistic armor. Military vehicles, in particular, are vulnerable to higher-potency weapons such as rocket-launched grenades and other projectiles. Military personnel want lightweight, fast and maneuverable vehicles, but they also want vehicle occupants to be fully protected. Ballistic steel armor plates, while relatively inexpensive, add thousands of pounds to a vehicle, many of which were not designed to carry such loads. This has resulted in numerous engine and transmission failures as well as problems with vehicle suspensions and brakes. The additional weight reduces fuel efficiency and makes it impossible to carry additional personnel in the vehicle in case of emergency. For these reasons, designers are beginning to adopt more lightweight composite armor across the board for military and tactical vehicles.

Various lightweight armor designs are now becoming commercially available. Cellular Materials International, Inc. of Charlottesville, Va. offers a product called Microtruss™, a periodic cellular material designed to absorb a larger amount of energy than solid material of equal mass. When a blast hits the face of the sandwich panel, the face plate will stretch and wrinkle followed by the propagation of the impulse force into the core. The core will then buckle and collapse, absorbing the maximum kinetic energy of the blast. The back face plate takes the remaining blast pressure towards the end of the blast event where the intensity of the impulse force is considerably reduced. Thus, the periodic structure maximizes the absorption of the impulse energy created by the blast and distributes or diffuses the intensity of the force, leading to protection of the assets behind the sandwich structures.

Designs using ceramic pellets are also evolving. U.S. Pat. No. 6,203,908 is directed to a composite armor for absorbing and dissipating kinetic energy from high velocity projectiles. The armor comprises a panel having a layer of a plurality of high density ceramic bodies, the bodies having a specific gravity of at least 2 and being made of a material selected from the group consisting of ceramic material which does not contain aluminum oxide and ceramic material having an aluminum oxide content of not more than 80%. Each of the bodies is substantially cylindrical in shape, with at least one convexly curved end face, and each of the bodies having a major axis substantially perpendicular to the axis of its respective curved end face, wherein the ratio D/R between the diameter D of each of the cylindrical bodies and the radius R of curvature of the respectively convexly curved end face of each of the bodies is at least 0.64:1, and wherein the bodies are arranged in a plurality of adjacent rows and columns, the major axis of the bodies being in substantially parallel orientation with each other and substantially perpendicular to an adjacent surface of the panel.

Ballistic armor utilizing ceramic components is also commercially available. ARES Protection, Le Bourg 38270, Primarette, France offers a product called LIBA, which stands for light improved ballistic armor. The armor is a system consisting of one or more layer(s) of spherical ceramic pellets glued with (or without) a backing material and embedded in a polyurethane matrix. LIBA is for body and vehicle protection applications, especially to stop AP ammunitions. LIBA is developed for protection against WC bullets and hollow charges.

Despite these advances, the need remains for an improved, more optimized lightweight composite armor for military and tactical vehicles and other applications.

SUMMARY OF THE INVENTION

The present invention improves upon existing composite armor designs through the use of optimally shaped ceramic pellets and a web system for patterning the pellets, improving manufacturability, and providing additional structural reinforcement. The result is lightweight, composite hybrid structures for ballistic protection particularly suited to tactical ground vehicles.

The preferred embodiment is a combination of three major components: 1) an optimally designed web system that allows armor tiles to be attached to it and that can be easily integrated with existing vehicle structures; 2) an advanced composite armor unit using a patent-pending BTR (Bio-mimetic Tendon-Reinforced) material as the supporting structure; and 3) optimally placed "waiting materials" which can provide enhanced ballistic impact resistance, energy absorption capability and structural integrity. These "waiting materials" are structural members that are not active at the beginning of the ballistic impact, but become active when needed or the active members have failed.

The composite armor system exhibits the following features:

1. Ultra-light-weight compared with existing armor structures
2. Flexibility to fit various vehicle bodies and contours
3. Superior impact energy absorption capability due to the unique design of the armor unit
4. Superior strength for structural integrity due to the tendon-reinforcements
5. Capability to resist heat and flame due to the flexibility to select desirable parent materials for the composite
6. Ease of manufacture, maintenance and repair, and low life-cycle cost due to the fact that armor units can be installed and removed individually
7. Applicability to other military applications and to commercial vehicle systems.

The armor structures and materials are designed using an optimization technique and associated computational code called Function-Oriented Material Design. Using this tool, each component of the armor system is designed optimally with respect to its functions, without wasting any material. Due to the flexibility of the proposed system, the new armor can also be used, with minimum modifications, to protect commercial vehicles when necessary. The armor system can be further extended for other usages, for example, in a chair-based armor system to protect driver and passengers, or attached to office walls to protect officers, or even as a personal armor.

DETAILED DESCRIPTION OF THE INVENTION

Figure 1A:
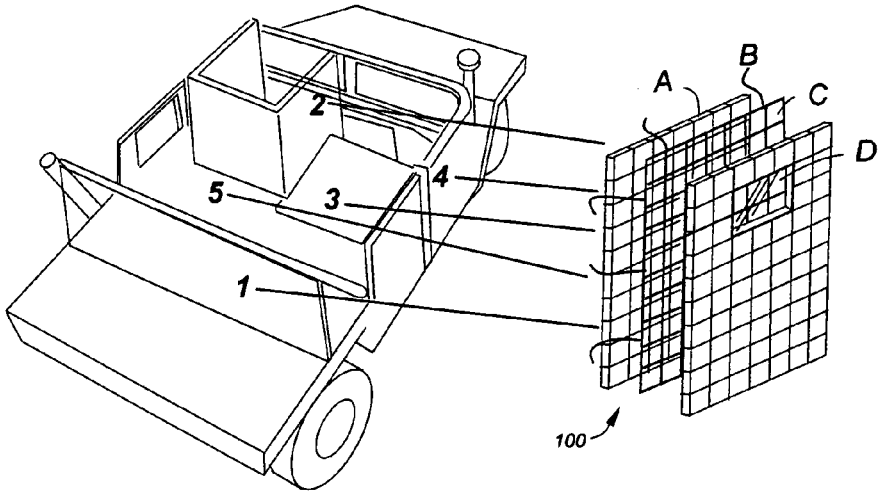
FIG. 1A shows composite armor characteristics and vehicular installation positions.

Basic armor configuration 100 according to the invention is illustrated in FIG. lA. The numbers in the vehicle on the left illustrate different armor placement options. "A" represents a fiber-reinforced composite layer with fragment protection. "B" refers to installation cables for connecting the armor to existing structures. "C" is a cable web structure for holding the armor tiles, with flexibility to fit different body shapes. "D" is a bullet-resistant transparent tile surrounded by advanced ceramic composite armor tiles which can be easily replaced.

FIG. lB shows different construction alternatives. Each include three major modules: 1) a functionally oriented material (FCM) tile 102 as the front plate, 2) a Bio-mimetic Tendon-Reinforced BTR back plate 104, and 3) supporting structure 106 using a fabric web. Various alternative embodiments are available in each case. As described in further detail below, the front plate may use pellets arranged in a regular structure (110), of the pellets may use a designed shape (112). The back plate may be constructed using any of the forms disclosed in co-pending U.S. patent application Ser. No. 11/023,923, the entire content of which is incorporated herein by reference. The front and back plates may be joined with a clip mechanism (114), or other disclosed alternatives may be used. In the preferred embodiment, the front and back plates are co-extensive, and arranged in an array shown at 100facilitating easier replacement. If the resulting "blanket" is draped over the front or side of a vehicle, an optional bullet-resistant window 120 may be provided.

The ceramic layer used in the front plate is preferably composed of a single- or multi-layered fabric network filled by thermoplastic polymer material and ceramic stones, which are arranged in a periodic pattern designed for improving the ballistic resistance, especially for multiple hits. The ceramic stone will have an optimally designed shape, which enhances the transferring of impact load onto surrounding stones. This feature results in desired compress stress among the stones, which reduces the crack propagation and improves the out-of-plane impact resistance performance.

The ceramic stones in the tile are seated in a fabric web, and are molded with the selected thermoplastic polymer material, which functions as impact absorber and position keeper of the stones. The fabric web in the ceramic layer has two major functions: one is to keep the stones in a desired arrangement and the other is to reinforce the ceramic layer during the ballistic impact.

The back plate features ultra-light weight and outstanding out-of-plane stiffness/strength. It is designed to have improved bending stiffness and strength for optimizing the armor performance. The fabric web is designed to hold the armor tiles (ceramic layer and back plate) in place and form an integrated armor kit that can fill into various vehicle contours. The optimally designed supporting structure also provides the advanced features for low cost and easiness to install, replace, and repair.

The Front Plate

As mentioned above, ceramic pellets layer provide benefits of improved ballistic performances due to cracks are constrained in a local area and multiple hit performance can be greatly improved. Inclined surfaces and boundaries of the ceramic mosaic due to the stones help to rotate the projectiles. In the design work, geometry shapes of the ceramic stones are design variables, which will be designed with the configuration of the whole ceramic layer. A simple geometry is preferably used depending on the commercial availability of the stones, for example, ceramic stones with spherical and cylindrical shapes may be used.

There are two kinds of ceramic stones (pellets) with simple shapes that are commercially available, including spherical and cylindrical versions. These pellets are used in manufacturing industry as grinding media in size-reduction mills of various types. We have identified pellets made from Alumina ($Al_2O_3$) with the purity of 93%.

Figure 2:
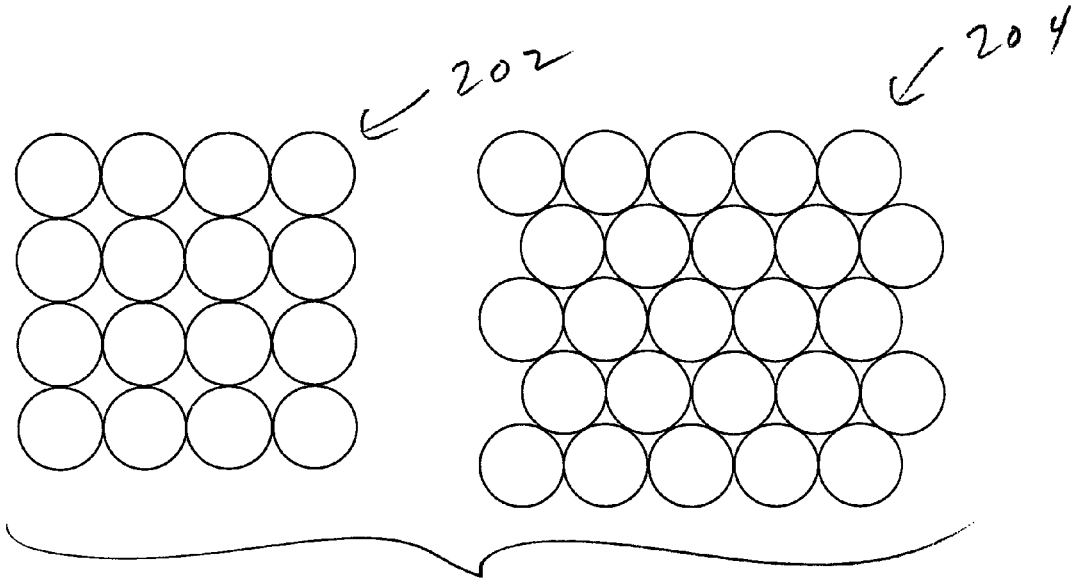
FIG. 2 shows two alternative patterns according to the invention.
Figure 3A:
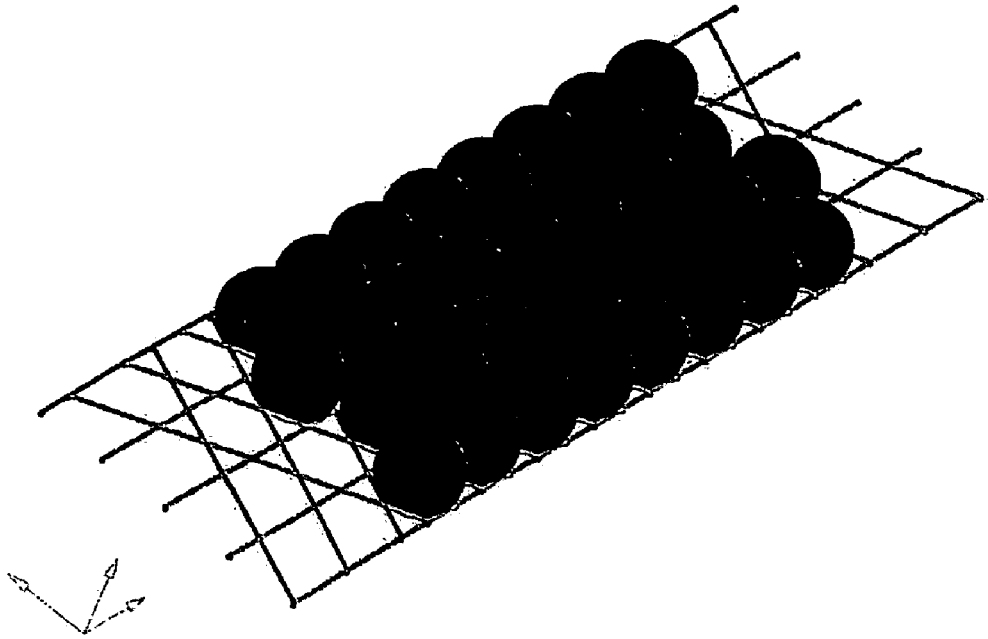
FIG. 3A shows pellets and net structures inside the ceramic based face plate.

There are two patterns for the ceramic stone layering, namely, the square and honeycomb arrangements 202, 204 as shown in FIG. 2. Due to the fact that the pellets will be molded in a matrix material, it is desirable that they are regulated and constrained in place and to form the desired pattern. At the same time, it is also desirable to have improved in-plane and out-plane bending stiffness and strength for ceramic layer. To achieve this goal, a single or multi-layered net structure is used as the pellet holder and the structural reinforcement, which will be molded in the matrix together with the pellets. Upon ballistic impact, the net structure will have additional reinforcement to the ceramic layer. One single-layered net design with honeycomb pattern is shown in FIGS. 3A and 3B.

Figure 3B:
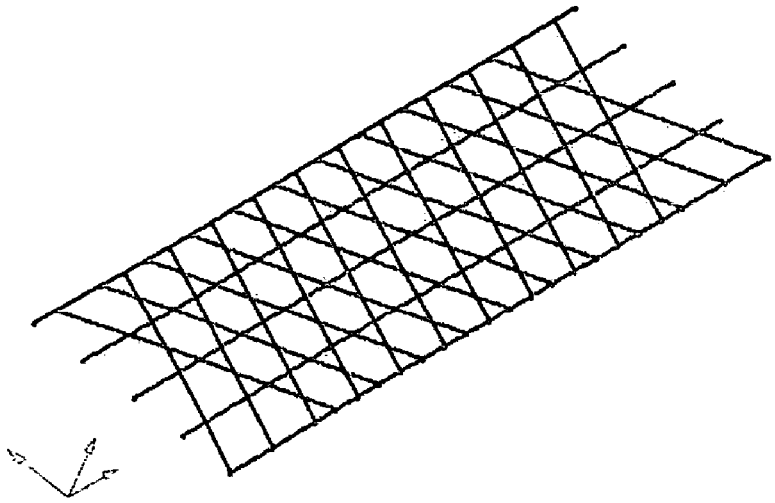
FIG. 3B shows the net structure aligned with the pellets to provide reinforcement.

From FIG. 3B, it is seen that the net structures will serve to align the ceramic spheres in the manufacturing process. After cured with the ceramic spheres, the net structures will provide reinforcement in resisting to the tension stress, which is one weakness of this layer with only the pellets and matrix. The net structure can also be three dimensional, which could provide additional reinforcement to the whole composite. The material for fabricating the web will be a selected high strength fiber, such as Kevlar.

The matrix material holds the ceramic pellets together and absorbs the impact energy under normal working conditions, so that the armor will not be so fragile in normal loading conditions. Under ballistic impact, it is expect the matrix material will not be strong enough to contribute to the defeat of the projectiles. However, it is expected that the matrix material have the capabilities to absorb impact energy and prevent damage to surround pellets. A thermoplastic material is applicable to this purpose, depending upon cost, manufacturability, and reparability.

The Back Plate

Figure 4:
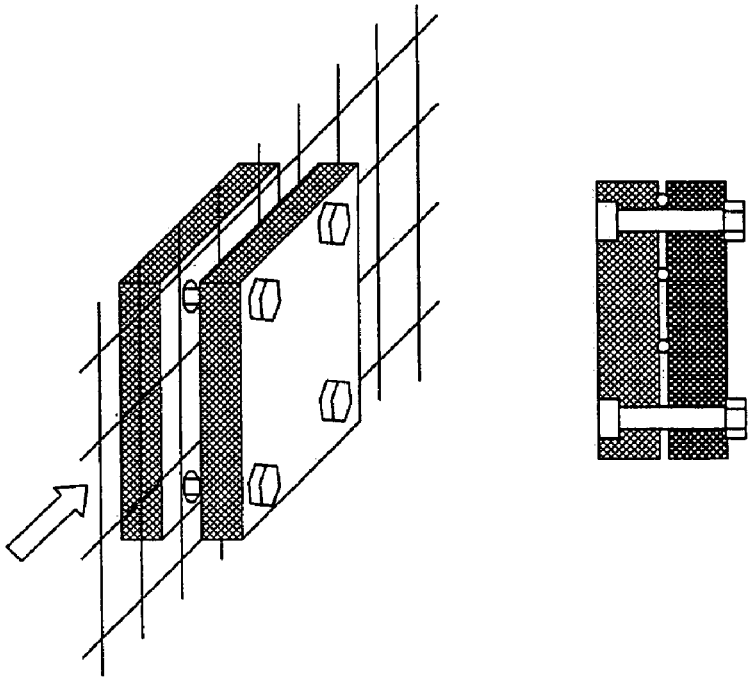
FIG. 4 shows a back plate using bolts.
Figure 5:
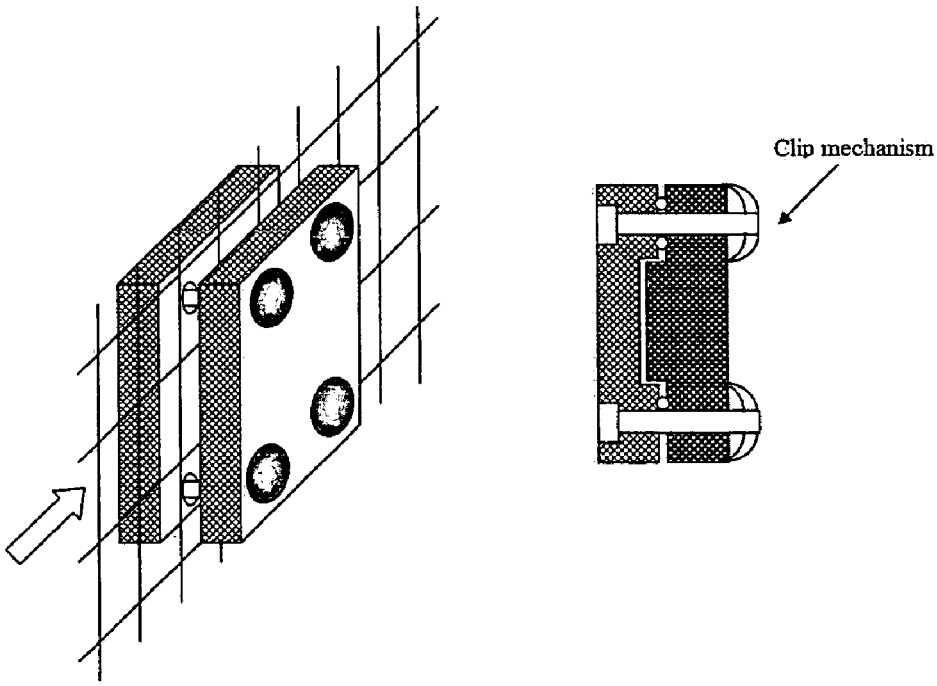
FIG. 5 shows groove and clip-on mechanisms.
Figure 6:
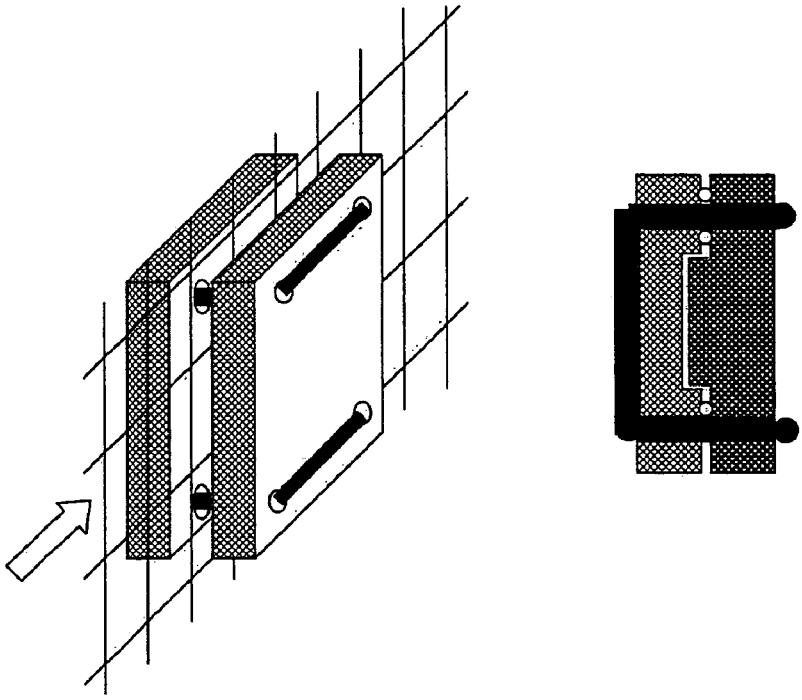
FIG. 6 shows a metallic wire fastener.

The back plate employs the patent-pending BTR material concept, which features ultra-light weight and outstanding out-of-plane stiffness/strength. With an appropriate mold, a number of sample back plates will be made, which will be used for basic mechanical tests and possible ballistic applications. The ceramic face plates may be connected to the back plates using bolts (FIG. 4), clip designs (FIG. 5), or metal wire/cable. (FIG. 6) The supporting structure (net structure) is clamped between the ceramic face plate and back plate, as shown in FIGS. 4 to 6.

Effectiveness

The ballistic impact of an assumed ceramic composite armor leads to damage mechanisms that are different in different stages of the penetration. At initial impact, the high hardness of ceramic materials helps to flatten the projectile tip. The damage to the ceramic is localized at this stage under the projectile due to only the compression is effective. In the second phase, the reflective wave (tensile wave) causes material damage at the back of the ceramic layer because ceramics are weak in tension. Shape of the damage zone is like a mushroom. Then cracks initiate from the root of the "mushroom" because of the bending of the ceramic layer. At the same time, the cap of "mushroom" becomes larger, expanding inside the ceramics with a certain angle (~60°) relative to the axis of the "mushroom". Finally, the radical and "mushroom cap" cracks caused fragmentation of the ceramic layer and the debris is kept in space to stop the projectile with the help of back plate. This process continues until the back plate fails.

Ceramic materials are hard and brittle. The high hardness contributes to flatten the nose part of the incoming projectiles, which increases the forces to stop the projectiles. The brittle properties of ceramics are not good for sustained defeating of projectiles, however, the damage zone forms due to this helps to distribute the impact force over a larger area. Another effect of brittleness of ceramic material is the long cracks usually expand from the point of hit due to bending. The long cracks and resulting small pieces of ceramic material are harmful for the defeat of projectiles, because not much constraint exist in-plane to keep the material in the damage zone and to contribute resistance forces.

As mentioned in the previous section, there are many mechanisms which help to improve the ballistic performance of armor. There are also many other mechanisms which compromise the overall performances. The goal is to promote the "good" mechanisms, and suppress "bad" ones. We identified good mechanisms as:

A) Hardness of ceramic to flatten the tip of projectile at the initial stage of impact;

B) Transference of impact force to surrounding and supporting materials;

C) Constraints of material to prevent material "flee" from the impact zone;

D) Other aspects to defeat projectile by involving more materials in the impact zone;

and bad mechanisms as:

E) Long cracks propagation;

F) Large damage zone.

Based upon these observations, the ceramic layer will preferably include ceramic stones (pellets) to form a mosaic as opposed to an entire piece of ceramic material. With this approach, the following advantages should be realized:

A) The hard pellets will be able to flatten the tip of the projectile;

B) The special geometry of the pellets will be able to transfer the impact force (in form of compressive stress) to surrounding pellets as far as possible;

C) Special shape of the surrounding pellets helps to hold the material in the impact zone;

D) If the projectiles can be designed to change the penetration angle of the bullet, the armor will be much more effective. Therefore, the bigger the angle change is, the better the armor performances will be;

E) Boundaries between the pellets help to stop the propagation of cracks;

F) Damage will be restricted in a limited range due to the fact that long cracks can be stopped from its initiating stage.

Figure 7:
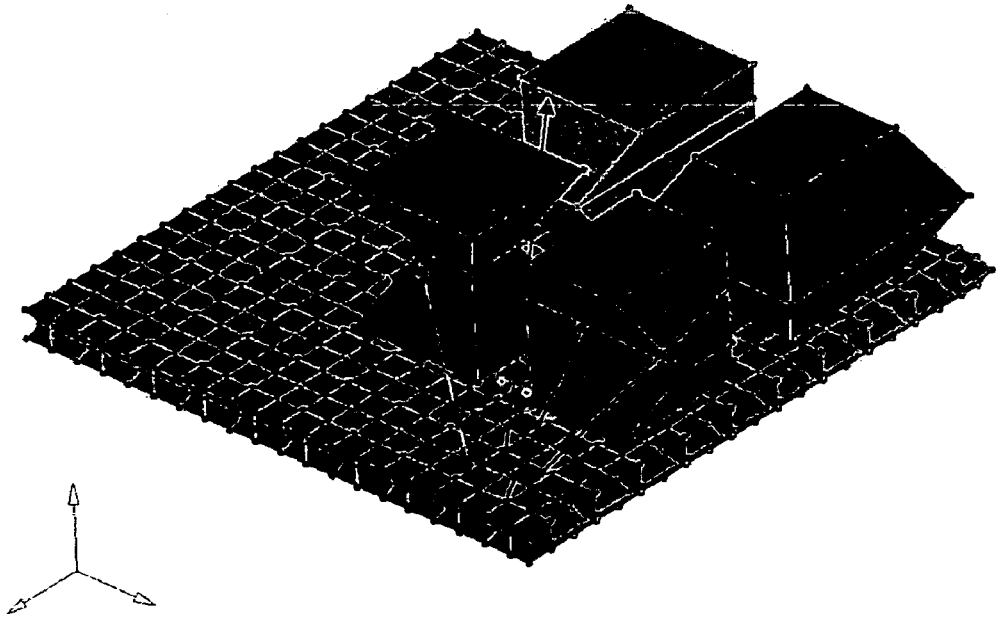
FIG. 7 shows a concept for ceramic layer with improved performances.

The ceramic layer design can be seen as an effort to promote the above features by optimally configuring the basic components in the ceramic layer. FIG. 7 illustrates an example concept of the ceramic mosaic. In this concept, the ceramic stones have a particular geometry, which helps to transfer impact load to surrounding pellets. The transfer of force to surrounding tiles will be in form of compress stress, which is favorable for ceramic materials. Because the boundary of tiles restrains the propagation of cracks, the design will have better multi-hit performances. The pellets are molded in thermoplastic polymer materials, which functions as impact absorber and keep the tiles in place. The design will have better dynamic performances because of thermoplastic material used.

Using this approach, the projectile penetration angle can be deflected due to the asymmetric design of the ceramic stones. The angle deflection, although it is small, greatly improve the chance of defeating the projectile. Because a face plate composed of ceramic blocks will lack tension and bending strength, an optimized cable network will be included in the ceramic layer for reinforcement during normal work conditions and under ballistic impact. The matrix will be selected to absorb the shock wave and prevent ceramic damage in normal work conditions and under ballistic impact. Other important concerns include manufacturability and cost. Very special ceramic blocks can be costly. However, ceramic blocks are commonly used as grinding media.

Figure 8:
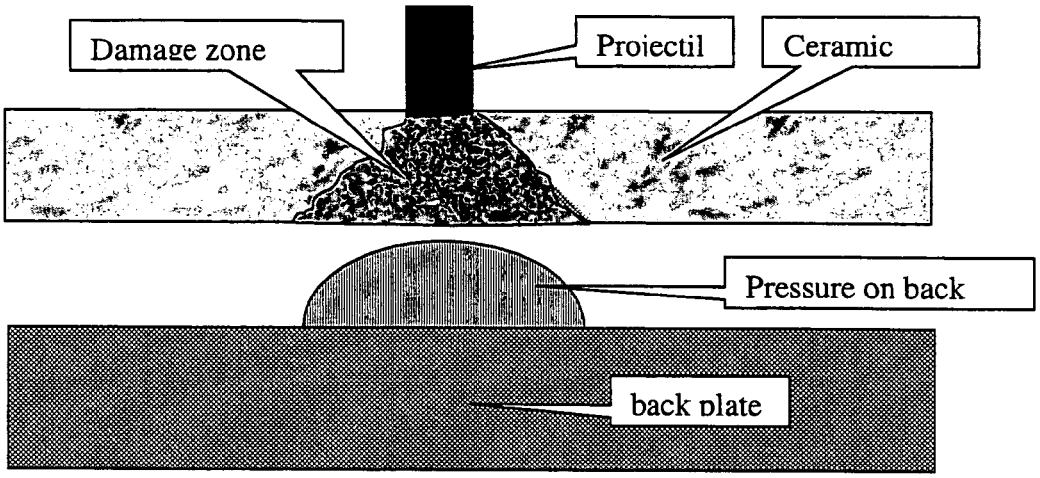
FIG. 8 shows impact force acting on the back plate.

As discussed above, the back plate should have large bending stiffness to prevent excessive bending of ceramic layer, the bending is an undesired deformation for the ceramic layer. At the same time, back plate should have large bending strength to hold the damage ceramic material in place to continue to stop the projectile. At the same time, the back plate should be able to collect debris from projectiles and ceramic layer and to stop them from penetration. Thus, the force acting on the back plate will be a distributed force, depicted in FIG. 8.

The Support Structure

The supporting structure is the structure between the armor kits and vehicle structures. It provides the benefit of easy installation, and also can be designed to improve the ballistic function of armor kits. Traditionally, armor kits are bolted on the structures for which they provide protection. If this traditional method is applied, there is an additional task to fit the geometry of the armor kit to the back structures. Therefore, we proposed an alternative method to mount the armor kits with an additional supporting structure. This supporting structure will provide additional benefits, such as easy to install, replace and repair.

At least two alternative supporting structures are possible. The first is a net structure that the armor kits are attached to, as shown in FIGS. 4-6. The benefit of this design will be lightweight and easy to install on different kinds of surfaces. The second one is made of fabric cloths, such as Kevlar, which has arrays of pockets that the armor tiles can be inserted in. This concept is similar to the body armor except a large number of armor inserts will be used.

Figure 9A:
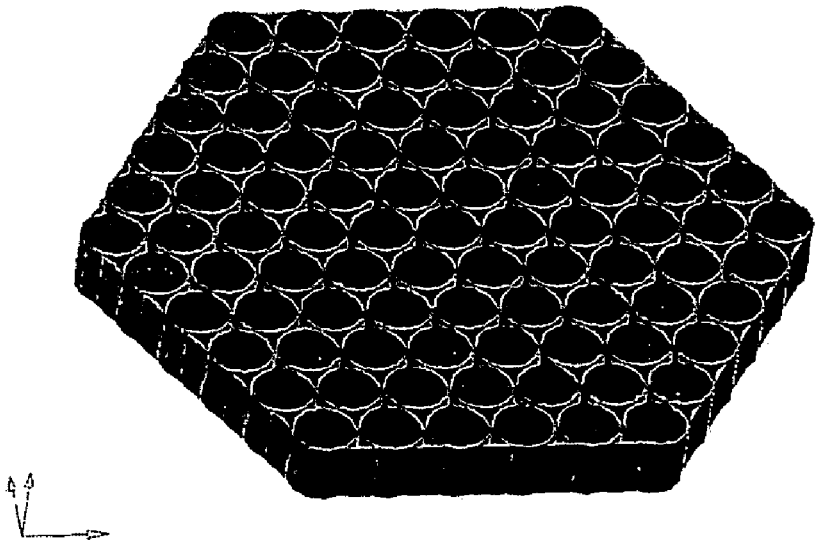
FIG. 9A illustrates ceramic cylinders.
Figure 9B:
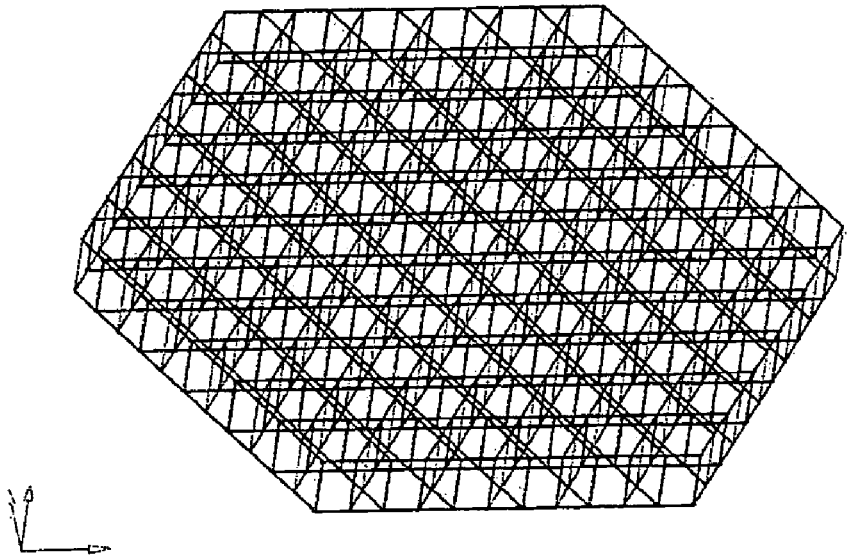
FIG. 9B illustrates a cable network.
Figure 9C:
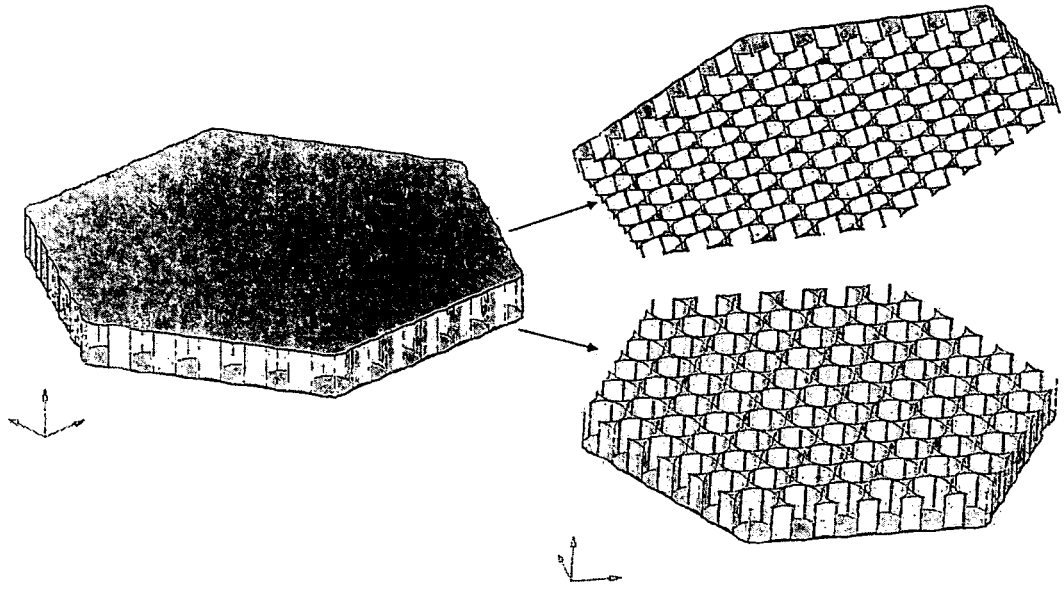
FIG. 9C illustrates a matrix.

In terms of materials, different kinds of materials are combined to defeat the projectile effectively. Ceramic pellets or cylinders function to damage and to rotate the projectiles. Optimized cable network provides reinforcement when tension and bending loads exist on the armor plate. Matrix material functions to absorb shock wave and to keep the structure integrity. FIGS. 9A-9C illustrates an armor design with ceramic cylinders, cable network, and matrix.

We have identified polycarbonate as a suitable matrix material. Aluminum is another suitable material. Kevlar is preferable as the cable material in the face plate and back plate because Kevlar is widely used in body armor and has superior ballistic performances.

Figure 12:
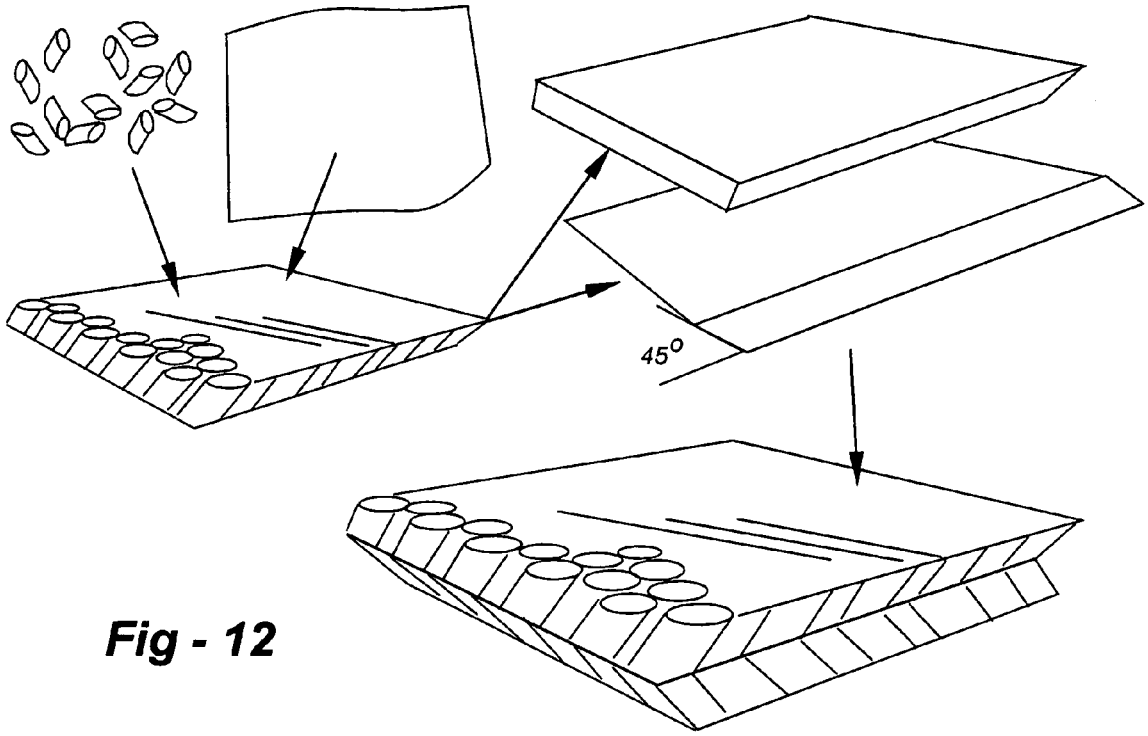
FIG. 12 illustrates the use of angle-cut cylindrical ceramic pellets.
Figure 1B:
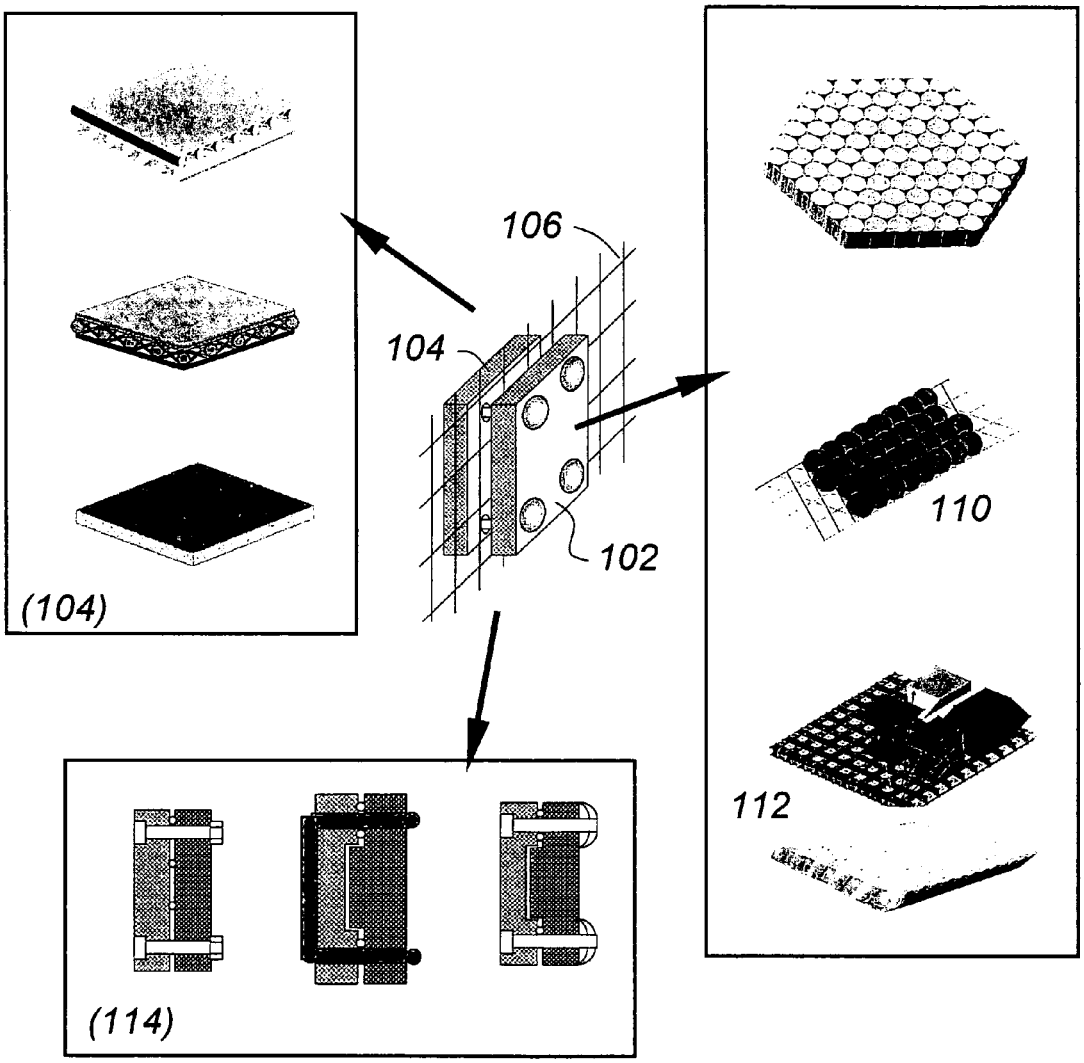
FIG. 1B shows different construction alternatives according to the invention.
Figure 10:
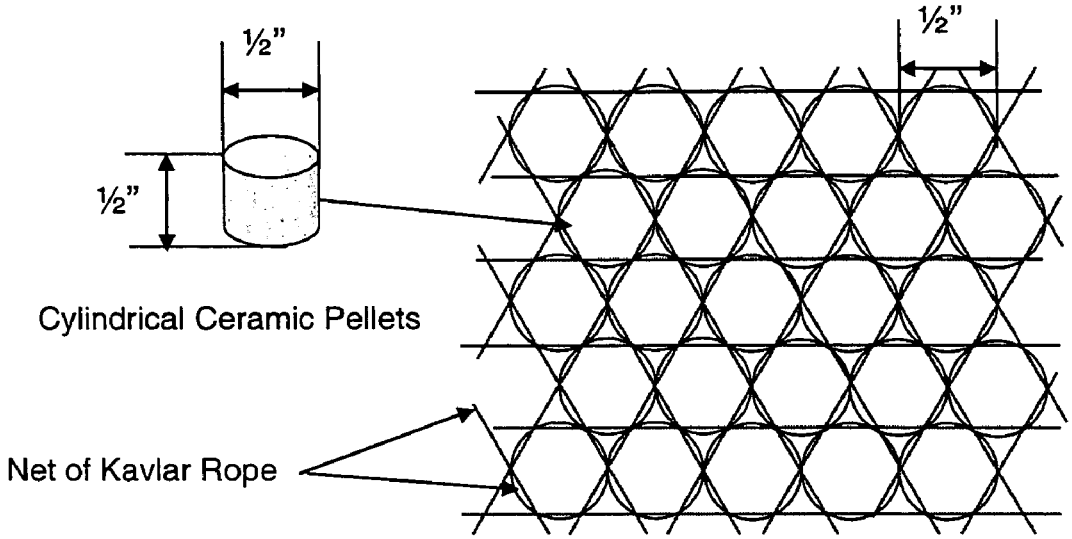
FIG. 10 illustrates a design with ceramic pellets and a cable network.
Figure 11:
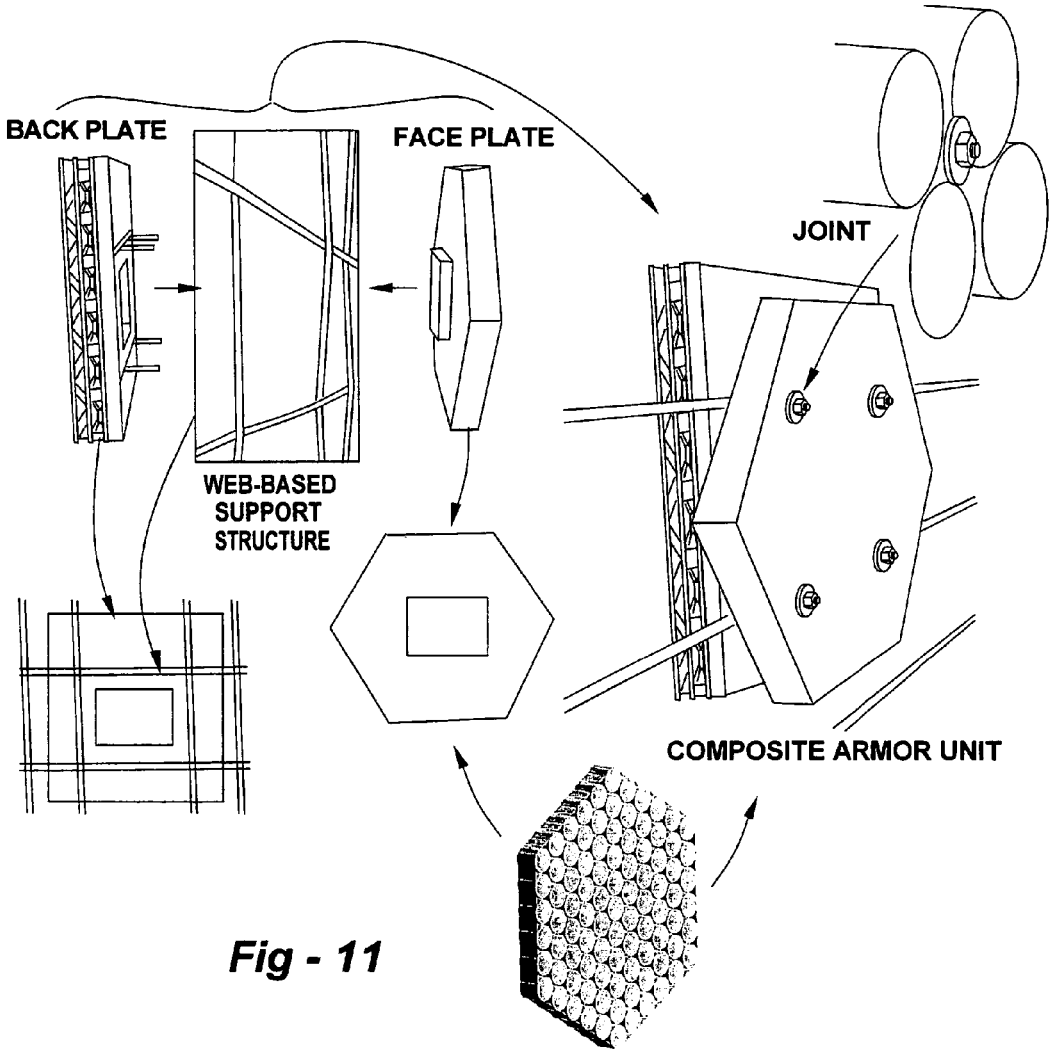
FIG. 11 shows a composite armor unit including a web-based supporting structure and pellet array.

FIG. 10 shows a ceramic pellet layout and a holding net designed for the face plate. This prototype face plate has a total volume of 272.8 $cm^3$, total weight of 832 g, and density of 3.05 $g/cm^3$, which is 60% lighter than steel (7.8 $g/cm^3$), 19% lighter than homogeneous ceramic (3.8 $g/cm^3$), and only 10% heavier than aluminum (2.7 $g/cm^3$). FIG. 11 shows a composite armor unit including a web-based supporting structure and pellet array, and FIG. 12 illustrates the use of angle-cut cylindrical ceramic pellets. From experimental results, it was found that two structural layers with ¼" hemp stuffers, 1/16" Kevlar ropes, 12 layers of woven Kevlar, and Epoxy matrix has the best performance in terms of bending stiffness.

I claim:

1. Lightweight, composite ballistic armor, comprising:

a flexible, web-based support structure;

a plurality of tiles attached to the support structure, each tile including a front plate disposed on one side of the support structure, a back plate disposed on the other side of the support structure, and one or more fasteners for joining each front plate to a corresponding back plate through the support structure; and wherein each front plate comprises an array of ceramic pellets embedded in a hardened matrix material.

2. The armor of claim 1, wherein the ceramic pellets are spherical.

3. The armor of claim 2, wherein the spherical ceramic pellets are arranged in a square matrix.

4. The armor of claim 2, wherein the spherical ceramic pellets are arranged in a hexagonal, close-packed matrix.

5. The armor of claim 1, wherein the ceramic pellets are cylindrical.

6. The armor of claim 5, wherein the cylindrical ceramic pellets are arranged in a square matrix.

7. The armor of claim 5, wherein the cylindrical ceramic pellets are arranged in a hexagonal, close-packed matrix.

8. The armor of claim 1, wherein:

each pellet has a plurality of flat surfaces; and the flat surfaces cooperate with one another to form an array of geometrically interlocking pellets.

9. The armor of claim 1, wherein each back plate is a composite structure including opposing panels filled with a resin impregnated matrix.

10. The armor of claim 1, wherein the back and front plates are co-extensive.

11. The armor of claim 1, wherein the web-based support structure can bend along lines between the tiles, resulting in a hinged sheet that can be draped over a vehicle or other thing to be protected.

12. The armor of claim 5, wherein:

each pair of tiles is arranged in a plane;

each cylindrical pellet has a lengthwise axis; and the axes of the pellets are parallel to one another but disposed at an angle relative to the plane of the tiles.

13. The armor of claim 1, wherein the ceramic pellets are bound together with a network of cables embedded in the hardened matrix material.

14. The armor of claim 1, wherein the back plate also comprises an array of ceramic pellets embedded in a hardened matrix material.

15. The armor of claim 14, wherein the ceramic pellets in the back plate are cylindrical, each with a lengthwise axis;

the axes of the pellets are parallel to one another but disposed at an angle relative to the plane of the tiles and the axes of the cylindrical pellets in the front plate.

16. Lightweight, composite ballistic armor, comprising:

a flexible support structure;

a plurality of tiles attached to the support structure to allow flexing of the support structure between the files, each tile including a front plate disposed on one side of the support structure, the front plate having pellets arranged therein, a back plate disposed on the other side of the support structure, and one or more fasteners for joining the front and back plates to one another through the support structure; and wherein the armor is attachable to an object via the support structure.

17. The armor according to claim 16, wherein the support structure includes a web material.

18. The armor according to claim 16, wherein the pellets are ceramic.

19. The armor according to claim 16. wherein the pellets are spherical.

20. The armor according to claim 16, wherein the pellets are cylindrical.

21. The armor according to claim 20, wherein each tile is arranged in a plane and each cylindrical pellet has a longitudinal axis, wherein the pellets are arranged such that their axes are parallel to one another but are not orthogonal to the plane of the tile.

22. The armor according to claim 16, wherein the pellets are arranged in a square matrix.

23. The armor according to claim 16, wherein the pellets are arranged in a honeycomb matrix.

24. The armor according to claim 16, wherein each pellet has a plurality of flat surfaces, the flat surfaces cooperate with one another to form an array of geometrically interlocking pellets.

25. The armor according to claim 16, wherein the back and front plates of each tile are co-extensive.

26. The armor according to claim 16, wherein the pellets are bound together with a network of cables embedded in a hardened matrix material.

27. Lightweight, composite ballistic armor, comprising:

a flexible support structure;

a plurality of tiles attached to the support structure, each tile including a front plate disposed on one side of the support structure, a back plate disposed on the other side of the support structure, and one or more fasteners for joining the front and back plates to one another through the support structure; and wherein each front plate comprises an array of ceramic pellets bound together with a network of cables embedded in a hardened matrix material.

28. The armor according to claim 27, wherein the support structure includes a web material.

29. The armor according to claim 27, wherein the pellets are ceramic.

30. The armor according to claim 27, wherein the pellets are spherical.

31. The armor according to claim 27, wherein the pellets are cylindrical.

32. The armor according to claim 27, wherein the pellets are arranged in a square matrix.

33. The armor according to claim 27, wherein the pellets are arranged in a honeycomb matrix.

34. The armor according to claim 27, wherein the back and front plates of each tile are co-extensive.

35. Lightweight, composite ballistic armor, comprising:

a flexible, webbed support structure;

a plurality of tiles attached to the support structure, each tile including a front plate disposed on one side of the support structure, the front plate having cylindrical ceramic pellets arranged therein, a back plate disposed on the other side of the support structure, and one or more fasteners for joining the front and back plates to one another through the support structure; and wherein each tile is arranged in a plane, and each cylindrical pellet has a longitudinal axis, wherein the pellets are arranged such that their axes are parallel to one another but are not orthogonal to the plane of the tile.

* * * * *